United States Patent [19]

Ogawa et al.

[11] Patent Number: 4,652,515

[45] Date of Patent: Mar. 24, 1987

[54] SILVER HALIDE COLOR PHOTOGRAPHIC MATERIALS HAVING IMPROVED DEVELOPMENT CHARACTERISTICS

[75] Inventors: Tadashi Ogawa; Jun Arakawa; Satoshi Nagaoka; Yuichi Ohashi; Koji Tamoto, all of Minamiashigara, Japan

[73] Assignee: Fuji Photo Film Co., Ltd., Kanagawa, Japan

[21] Appl. No.: 762,450

[22] Filed: Aug. 5, 1985

[30] Foreign Application Priority Data

Aug. 8, 1984 [JP] Japan ..... 59-165848

[51] Int. Cl.[4] ..... G03C 1/46; G03C 1/08; G03C 7/26; G03C 7/32

[52] U.S. Cl. ..... 430/505; 430/504; 430/506; 430/544

[58] Field of Search ..... 430/504, 506, 544, 505

[56] References Cited

U.S. PATENT DOCUMENTS

| | | | |
|---|---|---|---|
| 3,892,572 | 7/1975 | Shiba et al. | 430/504 |
| 4,141,730 | 2/1979 | Minagawa et al. | 430/504 |
| 4,145,219 | 3/1979 | Kato et al. | 430/502 |
| 4,173,479 | 11/1979 | Ranz et al. | 430/559 X |
| 4,348,474 | 9/1982 | Scheerer et al. | 430/509 X |
| 4,500,634 | 2/1985 | Sakanoue et al. | 430/553 X |
| 4,539,289 | 9/1985 | Saito et al. | 430/506 |
| 4,543,323 | 9/1985 | Iijima et al. | 430/504 X |

*Primary Examiner*—John E. Kittle
*Assistant Examiner*—Mukund J. Shah
*Attorney, Agent, or Firm*—Burns, Doane, Swecker & Mathis

[57] ABSTRACT

A silver halide color photographic material which comprises a support having thereon at least two silver halide light-sensitive layers having essentially the same color sensitivity but different speeds and a light-insensitive layer positioned adjacent to the highest-speed layer of said light-sensitive layers and containing a compound which reacts with the oxidation products of a color developing agent to form a diffusible development restraining compound or a precursor thereof. The photographic material provides a color image having excellent graininess and color reproduction and has excellent characteristics of development processing.

12 Claims, No Drawings

SILVER HALIDE COLOR PHOTOGRAPHIC MATERIALS HAVING IMPROVED DEVELOPMENT CHARACTERISTICS

BACKGROUND OF THE INVENTION (1) Field of the Invention

This invention relates to silver halide color photographic materials and particularly to silver halide color photographic materials which provide a color image having excellent graininess and color reproduction and which have excellent characteristics of development processing.

(2) Description of the Prior Art

As is well-known, silver halide multilayer color photographic materials comprise a support formed of a cellulose ester or a polyester or the like having coated thereon at least one red-sensitive silver halide emulsion layer comprising a nondiffusible cyan dye-forming coupler, at least one green-sensitive silver halide emulsion layer comprising a nondiffusible magenta dye-forming coupler and at least one blue-sensitive silver halide emulsion layer comprising a nondiffusible yellow dye-forming coupler, which layers may further be divided to achieve specific purposes. For example, British Pat. No. 818,687 discloses a photographic material wherein at least one emulsion layer comprises two unit emulsion layers, one of which is a low-speed layer placed near to the support and the other of which is a high-speed layer placed over the low-speed layer to thereby improve the sensitivity of the photographic material. British Pat. No. 923,045 discloses that graininess of a color image may be improved by controlling the maximum color density of a high-speed unit emulsion layer. Japanese Patent Publication No. 49-15495 discloses a high-speed multilayer color photographic material which comprises red-sensitive, green-sensitive and blue-sensitive layers, at least one of which layers comprises three unit emulsion layers, the uppermost layer of which has the highest-speed and the lowermost layer of which has the lowest-speed.

It is known to incorporate into these color photographic materials a compound which reacts with the oxidation products of a color developing agent to release a development restrainer or a precursor thereof, i.e. the so-called DIR compound. Japanese Patent Application (OPI) (unexamined published application) No. 49-42345 discloses incorporation of a DIR coupler into the low-speed emulsion layer of the aforementioned photographic material comprising high- and low-speed emulsion layers and Japanese Patent Application (OPI) No. 53-7230 discloses incorporation of a DIR compound into the medium-speed emulsion layer of the aforementioned photographic material comprising high-, medium- and low-speed emulsion layers.

The incorporation of the DIR compound into the medium-speed emulsion layer (and the removal of the DIR compound from the high-speed emulsion layer) increases sensitivity, improves image graininess or sharpness, or the ratio of sensitivity to graininess and further extends exposure latitude.

Thus, it has been known that a DIR compound improves image graininess or sharpness and color reproduction. A development restrainer released from the DIR compound depending on an image density restrains the development to thereby make the color image particles finer and diffuses in the direction parallel to the emulsion layer to cause the Eberhard effect, improving sharpness, and also in the direction perpendicular to the emulsion layer to cause a development restraining effect on the other emulsion layers, i.e. an interlayer development restraining effect to thereby increase saturation of colors, resulting in an improvement in color reproduction. Japanese Patent Application (OPI) No. 59-131934 discloses that the improvement in image sharpness and color reproduction may be intensified by suitably increasing the distance between the site where a development restrainer is split-off and released during development and the site where the development restrainer works.

In the field of silver halide color photographic materials, particularly materials for photographing, realization of high-quality color images has become a major concern with the current tendency toward miniaturization of cameras.

However, it is known that when a DIR compound is used for improving image sharpness, graininess or color reproduction, such disadvantages as a decrease in sensitivity, flattening of gradation and, occasionally, a retardation in the progress of development occurs due to the development restraining effect of the DIR compound. Various research toward realizing high image quality without such disadvantages, including, for example, investigation into useful DIR compounds, has been conducted but the problems still remain unsolved. The results of such studies are seen, for example, in West German Pat. (OLS) No. 2704797 which discloses a layer structure wherein a layer comprising a DIR compound and a low-speed AgCl emulsion is interposed between a high-speed emulsion layer of a red-sensitive silver halide emulsion layer and that of a green-sensitive silver halide emulsion layer gives a photographic material which is high in sensitivity and exerts a great interlayer development restraining effect even in the area of low density. In the layer structure of this German Patent, a major portion of the development restrainer, which is released from the DIR compound in the interposed layer when it reacts with the oxidation products of a developing agent diffused into the interposed layer from green- or red-sensitive high-speed emulsion layer, is adsorbed on the low-speed silver chloride emulsion layer and contributes little to the development restraining effect on the photosensitive emulsion layer. Further the layer structure has a disadvantage in that the development restraining effect, if any, will be canceled by the development accelerating effect caused by the interaction between a silver bromoiodide emulsion in the photosensitive emulsion layer and the silver chloride emulsion, i.e. trapping of iodide ion by silver chloride or conversion of bromide ion by silver chloride. The photographic material disclosed in Japanese Patent Application (OPI) No. 53-7230 does not have such disadvantages as flattening of gradation or a retardation in the progress of development but it is still unsatisfactory because it is low in the interlayer development restraining effect, whereas it is high in the graininess-improving effect.

SUMMARY OF THE INVENTION

An object of the present invention is to provide a new silver halide color photographic material having excellent characteristics of development processing and providing a color image of excellent quality, more particularly to provide a silver halide color photographic material providing a color image of excellent graininess and color reproduction and having excellent developability. By the term "excellent developability" used herein is meant that the photographic material concerned can be quickly processed by a developing agent to provide an optimum density and the optimum density once produced does not increase further with time.

The above mentioned object of the present invention can be accomplished by a silver halide color photographic material which comprises a support having thereon at least two silver halide light-sensitive layers having essentially the same color sensitivity but different speeds, and a light-insensitive layer positioned adjacent to the highest-speed layer of said light-sensitive layers and containing a compound capable of forming a diffusible development restraining compound or a precursor thereof upon reaction with oxidation products of a color developing agent.

DETAILED DESCRIPTION OF THE INVENTION

Such compounds that form a diffusible development restraining compound or a precursor thereof are described in European Pat. No. 101,621 (U.S. Pat. No. 4,005,364) and Japanese Patent Application (OPI) No. 59-131,934. The magnitude of diffusibility of a development restrainer or a precursor thereof is determined according to the following method as described in European Pat. No. 101,621 and is preferably 0.4 or more, and particularly 0.95 or less in the present invention.

On a transport support, there are coated two layers having the following composition to make a light-sensitive material (SAMPLE B).

First layer:

A red-sensitive silver halide emulsion layer.

A gelatin coating solution which contains a silver bromoiodide emulsion (silver iodide: 5 mole %, average grain size: 4 microns) and Sensitizing Dye I ($6\times10^{-5}$ mole per mole of silver) used in Example 1 described later and added to render the emulsion red-sensitive, and coupler X (0.0015 mole per mole of silver) is coated on the support in the amount of 1.8 g silver/$m^2$ (2 microns in thickness).

Coupler X

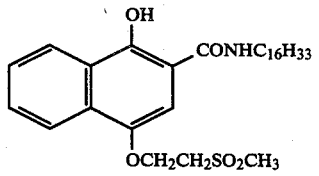

Second layer:

A gelatin layer containing a silver bromoiodide emulsion which is the same as that used in the first layer except that it is not red-sensitized and polymethylmethacrylate matting particles having a diameter of about 15 microns (the amount of silver coated: 2 g/$m^2$, 1.5 microns in thickness).

In addition to the above compositions, each layer contains a gelatin hardener, a surface active agent, etc.

SAMPLE A has the same construction as that of SAMPLE B except that the second layer does not contain the silver bromoiodide emulsion.

SAMPLES A and B are exposed to red-light through an optical wedge and developed in the same process as in Example 1 except that the time for development is 2 minutes 10 seconds. A development restrainer was added to the developer until the density of SAMPLE A is reduced to ½. The degree of density reduction of SAMPLE B developed in the developer containing such amount of the restrainer is a measure of diffusibility of the development restrainer in a silver halide emulsion layer.

The object of the present invention cannot be accomplished by only the use of the compound which releases a diffusible development restrainer or a precursor thereof but it is necessary to incorporate the compound into the light-insensitive layer adjacent to the highest-speed light-sensitive layer. It is preferred that the compound accounts for a stoichiometric amount of at least 50%, preferably at least 70% and more preferably 100% of all compounds which are incorporated in the light-insensitive layer and which cause a coupling reaction with the oxidation products of a developing agent.

The use of a DIR compound in the present invention is clearly distinguished from the conventional use of the DIR compound in the prior art wherein the DIR compound is used in a selected ratio, usually in a minor proportion, in combination with a non-DIR coupler in light-sensitive emulsion layers.

In the present invention solely by the use of the DIR compound it is possible to obtain a color image of excellent graininess and color reproduction and a photographic material of excellent characteristics of development processing.

It is summarized that the characteristic effects by the incorporation of the above mentioned compound into the light-insensitive layer adjacent to the highest-speed layer is caused by the following speculated mechanism.

When a DIR compound is contained together with a non-DIR coupler in a light-sensitive layer, the DIR compound reacts with the oxidation products of a developing agent depending on the mixing ratio and the relative coupling speed of the DIR compound to release a development restrainer which instantly starts restraining the development of silver grains.

If the development restraining effect is exerted quickly and strongly, grains which would otherwise develop slowly are almost completely prevented from being developed by the strong development restraining effect, which results in a decrease in the number of sites from which starts, to thereby degrade graininess and to decrease apparent sensitivity. Retardation of development at the initial stage degrades developability. These adverse effects are intensified when a large amount of the DIR compound is used for increasing the interlayer development restraining effect, as explained earlier.

In contrast, the present invention is characterized in that a DIR compound is incorporated into a light-insensitive layer adjacent to the highest-speed layer and it couples with the oxidation products of a developing agent transferred by diffusion from the light-sensitive emulsion layer to release a development restrainer which diffuses back into the light-sensitive emulsion layer where the development restrainer exerts the development restraining effect. As a result, the timing of the development restraint is delayed as compared with the case where the DIR compond is incorporated in the light-sensitive emulsion layer, fewer grains are extremely restrained from being developed, and the decrease in the number of sites from which development starts and the retardation of the initial development are reduced. The oxidation products of the developing agent formed in the light-sensitive emulsion layer by the reduction of silver halide diffuse into the adjacent light-insensitive layer where the oxidation products couple with the DIR compound incorporated therein, and therefore the amount of oxidation products which diffuse into the light-insensitive layer and react with the DIR compound is smaller at the initial stage of development when a coupler exists in the light-sensitive emulsion layer in an amount which is sufficient to react with the oxidation products but is larger at the latter stage of development when the coupler in the light-sensitive emulsion layer is exhausted and consequently the oxidation products of the developing agent formed in the light-sensitive layer diffuse excessively into adjacent layers. That is to say, the later the stage of development, the greater the amount of the DIR compound which reacts with the oxidation products becomes and the stronger the development is restrained. This prevents dye clouds from expanding and restrains the progress of development at the latter stage of development. This is believed to contribute to the improvement of graininess and developability. Generally, the lower the coupling speed of a DIR compound, the lower the rate of reaction of the DIR compound when it is in coexistence with another non-DIR coupler, and therefore the interlayer development restraining effect decreases, although developability is not so much degraded. Since the rate of reaction of the DIR compound is low particularly in the area of low density, the interlayer development restraining effect is also low in the area of low density. On the contrary, when the coupling speed of a DIR compound is high, developability is degraded although the interlayer development restraining effect remains high. In the present invention, since a major part of the compounds incorporated in the light-insensitive layer adjacent to the light-sensitive layer is accounted for by a DIR compound, the DIR compound reacts with the oxidation products of a developing agent diffused therein, and therefore a large interlayer development restraining effect can be exerted even in the area of low density regardless of the coupling speed and without degrading developability.

The effect of the present invention depends on the function of the oxidation products of a developing agent which are produced in a light-sensitive emulsion layer and diffuse into the adjacent layer and it is intensified by increasing the amount of the oxidation products diffused at the latter stage of development. Accordingly, a layer to which a DIR compound is incorporated is positioned adjacent to a layer having a high ratio of silver halide to coupler, usually a high-speed layer. This arrangement makes it easier to exert the interlayer development restraining effect from the low density area.

It is advantageous to use a compound which releases a diffusible development restraining agent or a precursor thereof for obtaining an adequate interlayer development restraining effect. The present invention makes it possible to use a large amount of a compound which forms a diffusible development restrainer or a precursor thereof without degrading developability and graininess to thereby increase the interlayer development restraining effect and consequently to achieve the significant improvement of color reproduction.

In the present invention compounds which react with the oxidation products of a color developing agent to form a diffusible development restraining compound or a precursor thereof are referred to as diffusible DIR compounds. Suitable examples of diffusible DIR compounds are diffusible DIR hydroquinones and preferably diffusible DIR couplers. The term "diffusible DIR coupler" as used herein means a coupler which reacts with oxidation products of a color developing agent to form or release a development restraining compound or a precursor thereof having large diffusibility during development. Suitable examples of diffusible DIR coupler include dye-forming DIR couplers, colorless compound-forming DIR couplers, etc.

Thus, the incorporation of a compound which releases a diffusible development restrainer or a precursor thereof into a light-insensitive interlayer adjacent to a high-speed emulsion layer gives a silver halide color photographic material having an excellent developability and provides a color image of excellent graininess and color reproduction.

The compound which forms a diffusible development restrainer or a precursor thereof is incorporated preferably in the range of 0.00001 to 0.002 mol/m$^2$, and more preferably 0.00002 to 0.001 mol/m$^2$.

In the present invention, it is preferred that the light-insensitive layer does not contain light-sensitive silver halide grains, but it may contain them under particular condition. This is because even if the light-insensitive layer contains light-sensitive silver halide grains, it may become substantially light-insensitve, when a compound which forms a diffusible development restrainer or a precursor thereof contained in the light-insensitive layer accounts for at least 50% of all the compounds contained therein which cause a coupling reaction with the oxidation products and it extremely restrains the development of the layer comprising the light-sensitive silver halide grains.

It is preferred that the light-insensitive layer of the photographic material of this invention does not contain any image dye-forming couplers other than the compound which reacts with the oxidation products of a color developing agent to form a diffusible development restraining compound or a precursor thereof, although it may contain them.

It is preferred that the photographic material of this invention further comprises a light-insensitive layer containing light-insensitive silver halide grains. The light-insensitive silver halide grains may be incorporated into the outermost protective layer or a color mixing preventing layer to prevent a diffusible development restrainer from flowing into processing liquids or to control the direction in which the diffusible development restrainer works.

The light-insensitive layer adjacent to the highest-speed layer may be positioned near to or remote from the support with respect to the highest-speed layer. The light-insensitive layer may be positioned adjacent to one or more of the blue-sensitive, the green-sensitive and the red-sensitive highest-speed layers.

Preferable diffusible DIR couplers which can be used in the present invention are represented by the formula (I):

$$A\text{-}(Y)_m \qquad (I)$$

wherein A represents a coupler component, m represents an integer of 1 or 2 and Y represents a coupling-off group which is linked to a coupling position of the coupler component A and can be eliminated from the coupler component upon the reaction with the oxidation products of a color developing agent to release a highly diffusible development restrainer or a precursor thereof.

In the formula (I), Y is preferably a group represented by the formulas (IIa) to (V).

[IIa]

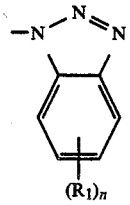

[IIb]

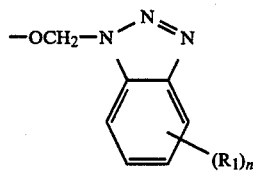

[III]

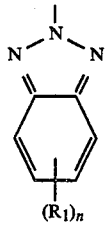

[IV]

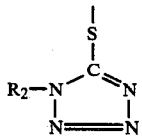

[V]

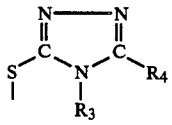

In the formulas (IIa), (IIb) and (III), $R_1$ represents alkyl, alkoxy, acylamino, halogen, alkoxycarbonyl, thiazolidinylidenamino, aryloxycarbonyl, acyloxy, carbamoyl, N-alkylcarbamoyl, N,N-dialkylcarbamoyl, nitro, amino, N-arylcarbamoyloxy, sulfamoyl, N-alkylcarbamoyloxy, hydroxy, alkoxycarbonylamino, alkylthio, arylthio, aryl, hetero ring, cyano, alkylsulfonyl or aryloxycarbonylamino group. In the formulas (IIa), (IIb) and (III), n represents an integer of 1 or 2, if n represents 2, $R_1$ may be the same or different and the total number of carbons contained in n $R_1$ is 0 to 10.

In the formula (IV), $R_2$ represents alkyl or aryl group or hetero ring.

In the formula (V), $R_3$ represents hydrogen, alkyl or aryl group or hetero ring, $R_4$ represents hydrogen, alkyl or aryl group, halogen, acylamino, alkoxycarbonylamino, aryloxycarbonylamino, hetero ring, alkylthio or amino group. If $R_1$, $R_2$, $R_3$ or $R_4$ represents alkyl group, it may be substituted or unsubstituted and chain or cyclic. The substituent can be halogen, nitro, cyano, aryl, alkoxy, aryloxy, alkoxycarbonyl, aryloxycarbonyl, sulfamoyl, carbamoyl, hydroxy, alkanesulfonyl, arylsulfonyl, alkylthio or arylthio group.

If $R_1$, $R_2$, $R_3$ or $R_4$ represents aryl group, it may be substituted. The substituent can be alkyl, alkenyl, alkoxy, alkoxycarbonyl, halogen, nitro, amino, sulfamoyl, hydroxy, carbamoyl, aryloxycarbonylamino, alkoxycarbonylamino, acylamino, cyano or ureido group.

If $R_1$, $R_2$, $R_3$ or $R_4$ represents hetero ring, it represents a 5- or 6-membered monocyclic or condensed ring containing nitrogen, oxygen or sulfur as a hetero atom, e.g. pyridyl, quinolyl, furyl, benzothiazolyl, oxazolyl, imidazolyl, thiazolyl, triazolyl, benzotriazolyl, imido or oxazine. The ring may further be substituted by the substituent described above as a substituent for the aryl group.

In the formula (IV), the number of carbon atoms contained in $R_2$ is preferably 1 to 15, and more preferably 1 to 5 when $R_2$ represents an unsubstituted alkyl.

In the formula (V), the total number of carbon atoms contained in $R_3$ and $R_4$ is 1 to 15.

In the formula (I), Y may be represented by the following formula (VI)

$$\text{—TIME—INHIBIT} \qquad \text{(VI)}$$

wherein TIME is a group which is linked to a coupling position of a coupler and is cleaved upon the reaction with the oxidation products of a color developer to control properly the release of INHIBIT group after the cleavage.

The INHIBIT group is a residue of a development restrainer.

Preferred examples of the TIME-INHIBIT group are those of the formulas (VII) to (XIII) as set forth below and also disclosed in U.S. Pat. No. 4,005,634 (European Pat. No. 101,621).

Of the diffusible DIR compounds, particularly preferable are those having an INHIBIT group represented by the formula (IIa), (IIb), (III), (IV) or (V).

Suitable examples of the yellow dye image forming coupler component represented by the group A in the formula (I) include those of pivaloylacetanilide, benzoylacetanilide, melonyldiester, molonylamide, dibenzoylmethane, benzothiazolylacetamide, malonic ester monoamide, benzothiazolylacetate, benzoxazolylacetamide, benzoxazolylacetate, benzimidazolylacetamide and benzimidazolylacetate types; those derived from hetero-ring substituted acetamides or hetero-ring substituted acetates as described in U.S. Pat. No. 3,841,880; those derived from acylacetamides as described in U.S. Pat. No. 3,770,446, British Pat. No. 1,459,171, West German Patent Application (OLS) No. 2,503,099, Japanese Patent Application (OPI) 50-139,738 or Research Disclosure No. 15737 (May, 1977); and hetero-ring type couplers as described in U.S. Pat. No. 4,046,574.

Preferable examples of a magenta dye image forming coupler component represented by the group A in the formula (I) include those of 5-oxo-2-pyrazoline nuclei, pyrazolo-1,5-a benzimidazole nuclei and cyanoacetophenone type components.

Preferred examples of a cyan dye image forming coupler component represented by the group A include those of phenol nuclei and α-naphthol nuclei.

Preferred examples of the group A of the formula (I) are those represented by the formulas (IA), (IIA), (IIIA), (IVA), (VA), (VIA), (VIIA), (VIIIA) and (IXA) as described in U.S. Pat. No. 4,055,634.

Specific examples of preferred diffusible DIR couplers are illustrated as follows:

D-1
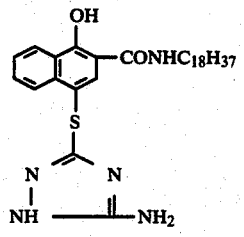
D-2
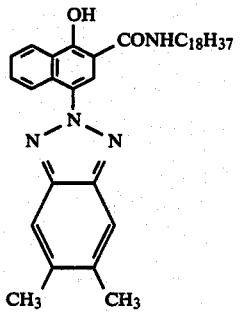
D-3
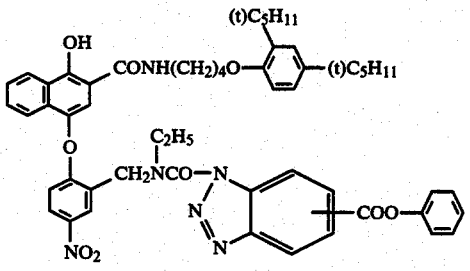
D-4
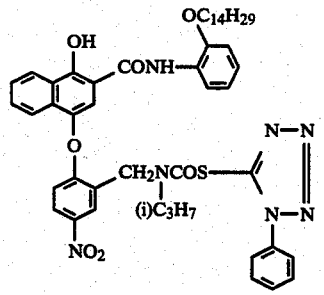
D-5
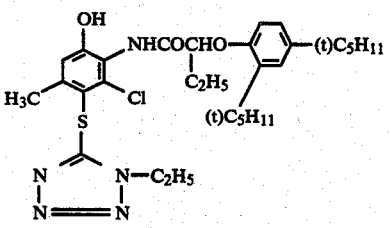
D-6
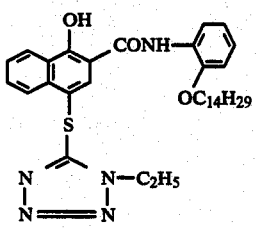
-continued
D-7
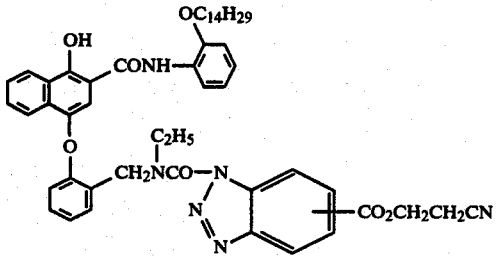
D-8
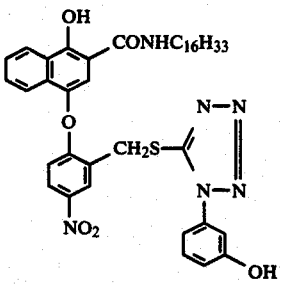
D-9
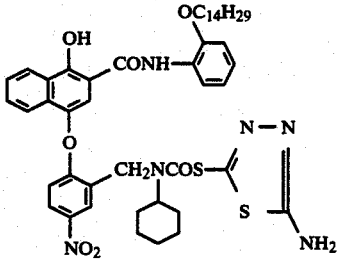
D-10
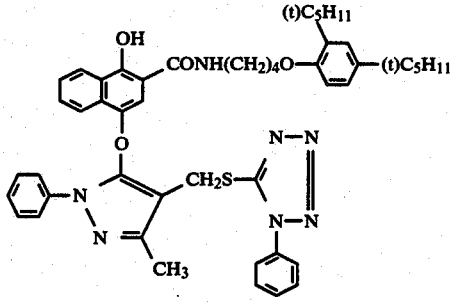
D-11
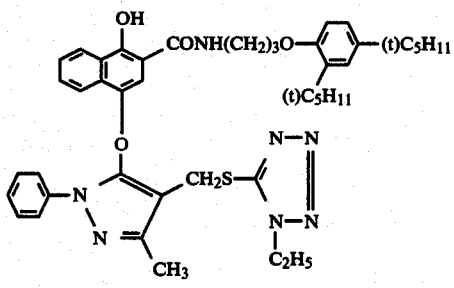
D-12
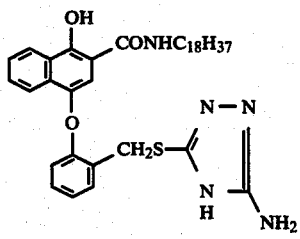

-continued
D-13
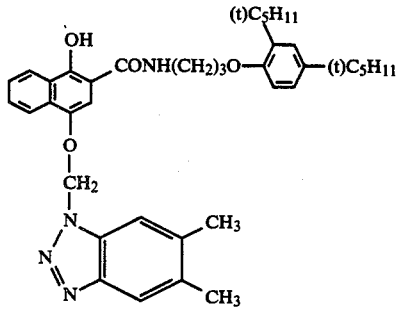
D-14
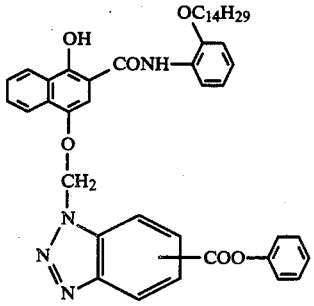
D-15
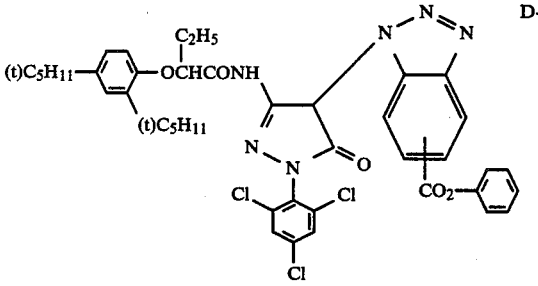
D-16
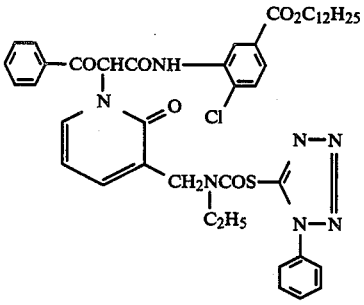
D-17
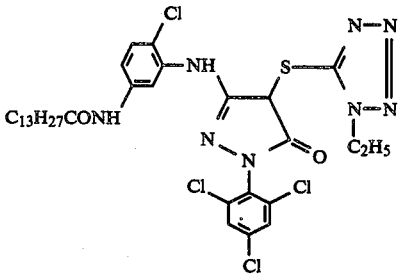
-continued
D-18
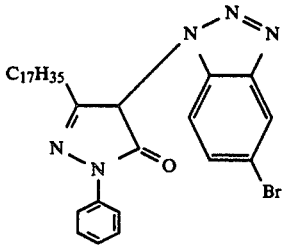
D-19
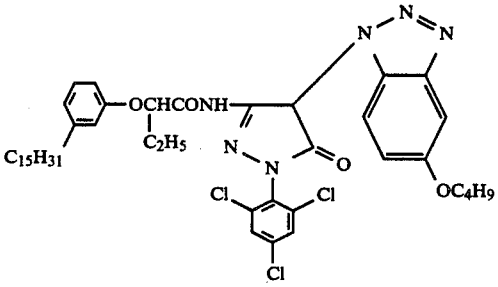
D-20
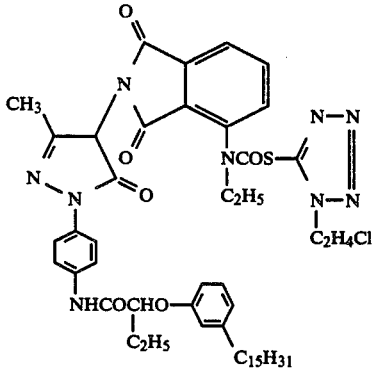
D-21
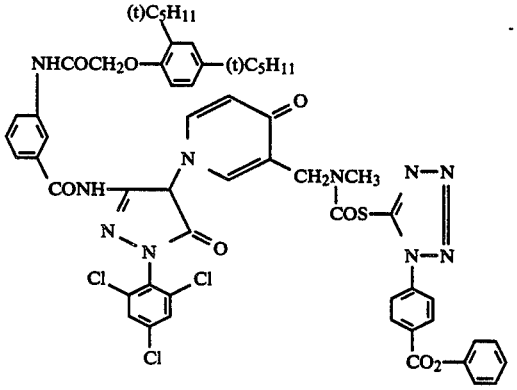

-continued
D-22
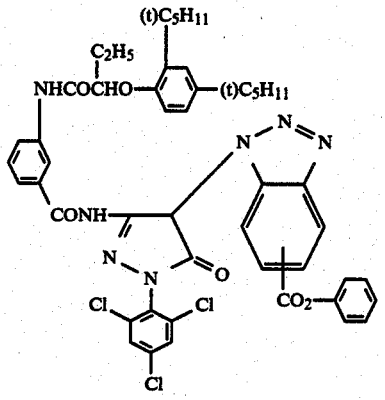
D-23
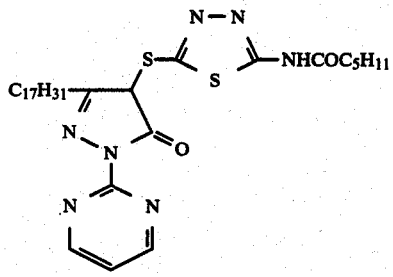
D-24
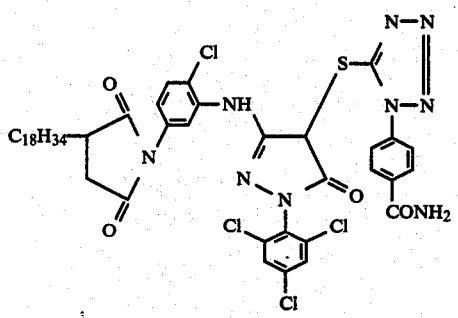
D-25
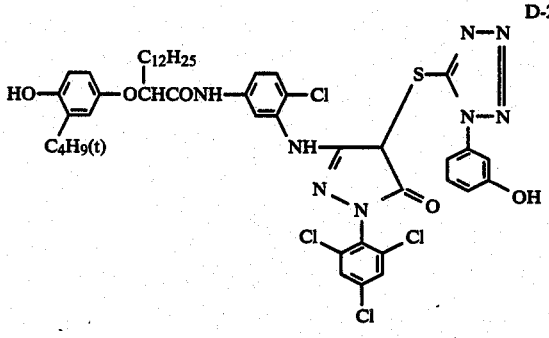
D-26
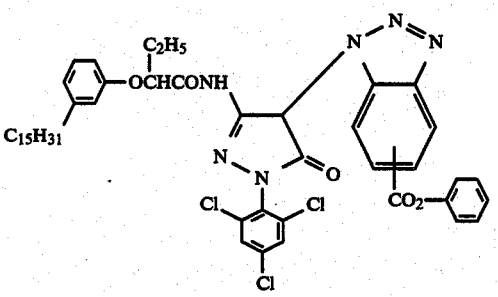
-continued
D-27
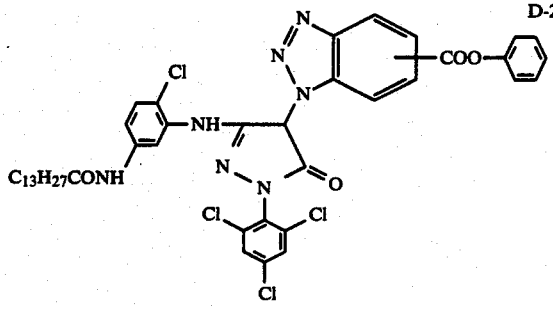
D-28
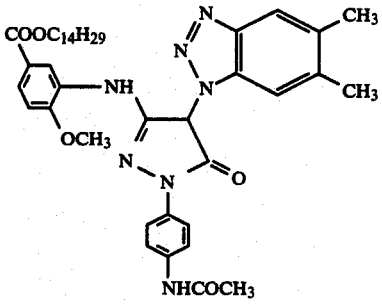
D-29
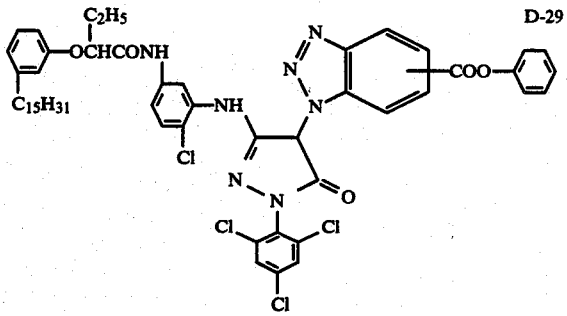
D-30
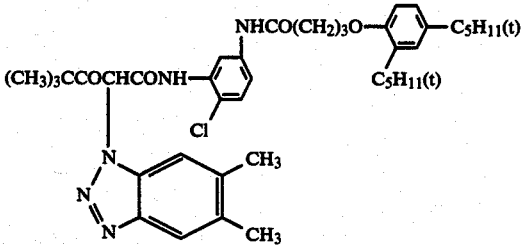
D-31
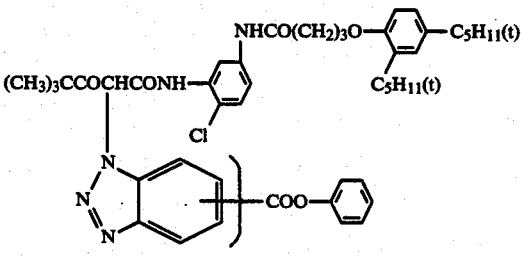

-continued
D-32
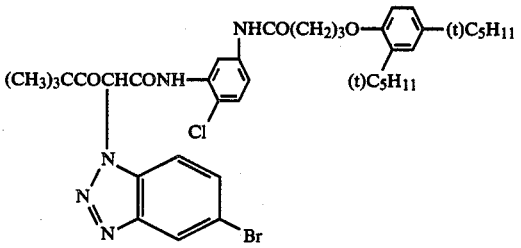
D-33
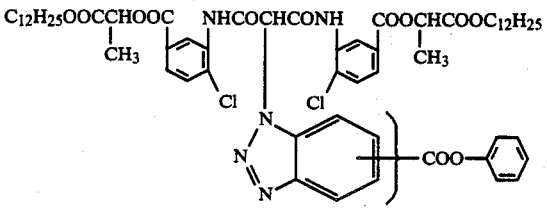
D-34
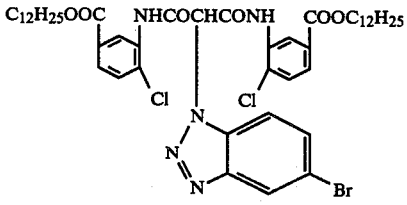
D-35
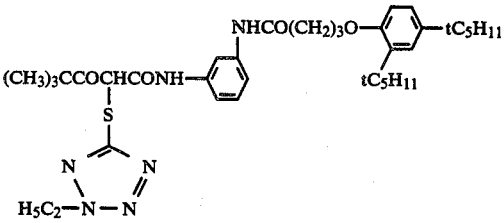
D-36
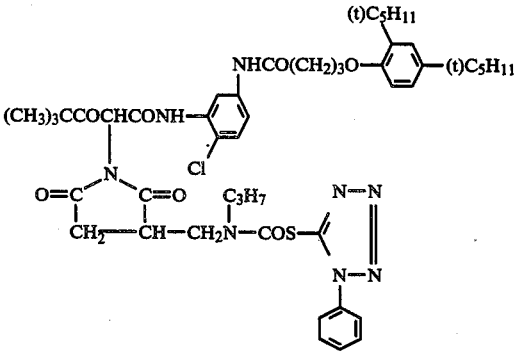
-continued
D-37
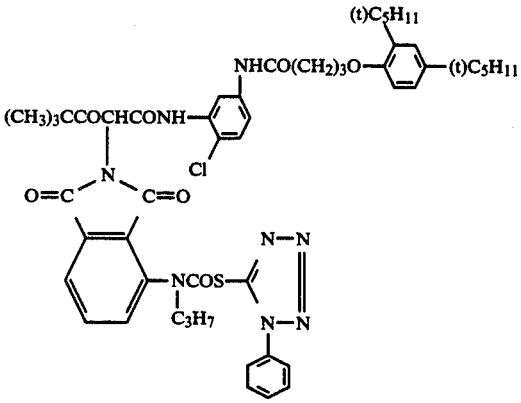
D-38
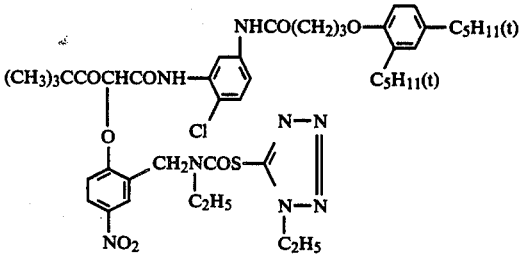
D-39
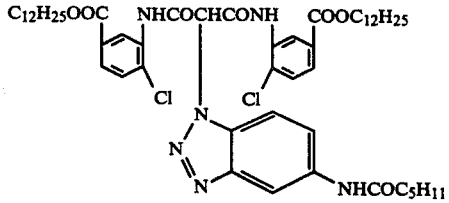
D-40
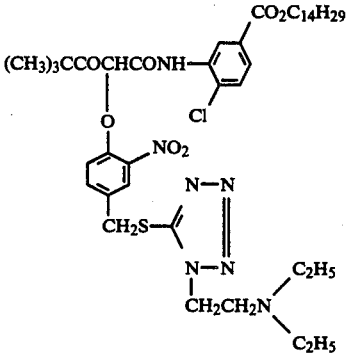
D-41
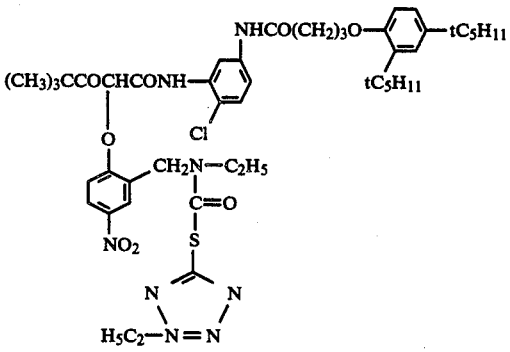

-continued

D-42

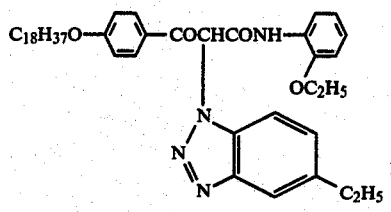

D-43

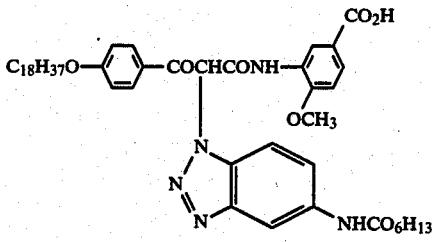

D-44

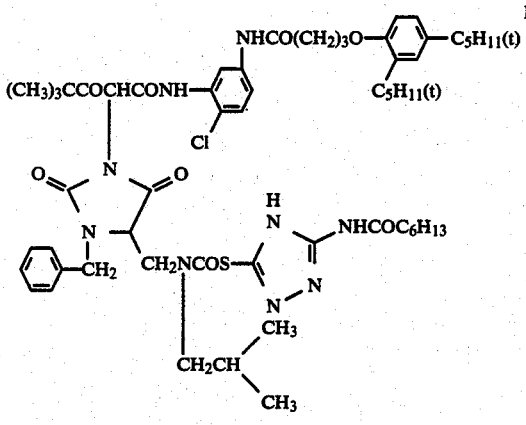

D-45

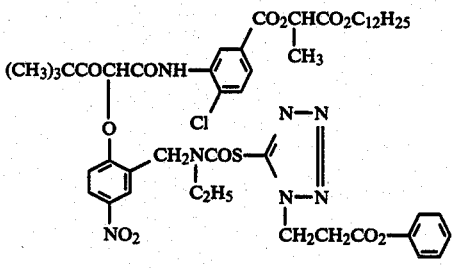

D-46

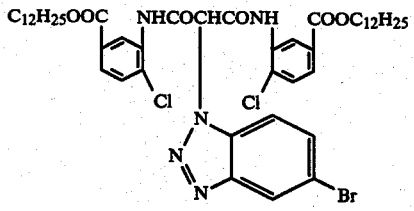

Particularly preferred diffusible DIR compounds which can be used in the present invention are those which form a diffusible development restrainer which loses the development restraining property after it diffuses into a developing solution.

The diffusible DIR compounds which can be used in the present invention can easily be prepared by the methods described in U.S. Pat. Nos. 3,227,554, 3,617,291, 3,933,500, 3,958,993, 4,149,886 and 4,234,678; Japanese Patent Application (OPI) Nos. 51-13239 and 57-56837; British Pat. Nos. 2,070,266 and 2,072,363; and Research Disclosure No. 21228 (December, 1981).

In the present invention, any known methods as described in U.S. Pat. No. 2,322,027 can be used to incorporate the diffusible DIR compounds and other couplers explained later into a silver halide emulsion layer or a light-insensitive layer. For example, they are dissolved in a solvent such as phthalic acid alkyl esters (e.g. dibutyl phthalate, dioctyl phthalate, etc.), phosphates (e.g. diphenyl phosphate, triphenyl phosphate, tricresyl phosphate, dioctyl butyl phosphate, etc.), citrates (e.g. tributyl acetylcitrate, etc.), benzoates (e.g. octyl benzoate), alkylamides (e.g. diethyllaurylamide), aliphatic acid esters (e.g. dibutoxyethyl succinate, diethyl azelate, dioctyl azelate, etc.), trimesic acid esters (e.g. trimesic acid tributyl ester), etc., or organic solvents having a boiling point of about 30° C. to about 150° C., such as lower alkyl acetates (e.g. ethyl acetate, butyl acetate), ethyl propionate, sec-butyl alcohol, methyl isobutyl ketone, beta-ethoxyethyl acetate, methylcellosolve acetate, etc. and then dispersed into a hydrophilic colloid. A mixture of these high and low boiling point solvents may also be used.

The dispersing method using the polymer as described in Japanese Patent Publication No. 51-39853 and Japanese Patent Application (OPI) No. 51-59943 may also be used.

Couplers having an acid group such as carboxyl or sulfonic may be introduced to a hydrophilic colloid in the form of an aqueous alkaline solution.

Gelatin is most suitable as a binder or protective colloid used in emulsion layers or interlayers of the photographic material of this invention, although other hydrophilic colloids may be used alone or together with gelatin.

Examples of such hydrophilic colloids include proteins such as gelatin derivatives, graftpolymers of gelatin and other polymers, albumin, casein, etc.; saccharides such as cellulose derivatives such as hydroxyethyl cellulose, carboxymethyl cellulose, cellulose sulfate, etc., sodium alginate, starch derivatives, etc.; and various synthetic hydrophilic high molecular weight substances such as homopolymers or copolymers, for example, polyvinyl alcohol, polyvinyl alcohol semiacetal, poly-N-vinylpyrrolidone, polyacrylic acid, polymethacrylic acid, polyacrylamide, polyvinyl imidazole, polyvinyl pyrazole, etc.

In the present invention, lime-processed gelatin, acid-processed gelatin, enzyme-processed gelatin as described in Bull. Soc. Sci. Photo. Japan No. 16, page 30 (1966), gelatin hydrolysates or enzyme treated gelatin may be used. Examples of gelatin derivatives include those obtained by the reaction between gelatin and various compounds such as acid chlorides, acid anhydrides, isocyanates, bromoacetic acid, alkanesultones, vinylsulfonamides, maleicimides, polyalkyleneoxides, epoxy compounds, etc.

In the emulsion layers of this invention, there may be used any of silver bromide, silver bromoiodide, silver bromochloroiodide, silver chlorobromide and silver chloride. A preferred silver halide is silver bromoiodide containing 15 mole % or less of silver iodide. A particularly preferred one is silver bromoiodide containing 2 to 12 mole % of silver iodide.

The average size of the silver halide grains of the photographic emulsion is not particularly limited but it is preferably 3 microns or less, wherein the average grain size means the average diameter for spherical or nearly spherical grains and the average edge length for cubic grains and these average values are calculated from projected surface area.

The grain size distribution may be narrow or broad.

Silver halide grains in the photographic emulsion may be of regular forms such as cubic or octahedral grains, of irregular forms such as spherical or tabular grains, of complex forms thereof, or mixtures thereof.

There may also be used an emulsion wherein tabular grains having a diameter-thickness ratio of at least five constitute 50% or more of the total projected area of silver halide grains.

Silver halide grains may be of a layer structure wherein the inner layer and the outer layer are different in phase of joining structure or of uniform phase structure. Silver halide grains may be those in which a latent image is formed mainly on the surface thereof, or those in which a latent image is formed mainly in the interior thereof.

The photographic emulsion used in this invention can be prepared in any manner, e.g., by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of an acid process, a neutral process, an ammonia process, etc., can be employed.

Soluble silver salts and soluble halogen salts can be reacted by techniques such as a single jet process, a double jet process, or a combination thereof. In addition, there can be used a method in which silver halide grains are formed in the presence of an excess of silver ions (so-called reversal mixing process).

As one system of the double jet process, a so-called controlled double jet process in which the pAg in a liquid phase where silver halide is formed is maintained at a predetermined level can be employed. This process can produce a silver halide emulsion in which the crystal form is regular and the grain size is nearly uniform.

Two or more kinds of silver halide emulsions which are prepared separately may be used as a mixture.

The formation or physical ripening of silver halide grains may be carried out in the presence of cadmium salts, zinc salts, lead salts, thallium salts, iridium salts or complex salts, rhodium salts or complex salts, iron salts or complex salts, and the like.

For removal of soluble salts from the emulsion after precipitate formation or physical ripening, a well known noodle washing process in which gelatin is gelated may be used. In addition, a flocculation process utilizing inorganic salts having a polyvalent anion (e.g., sodium sulfate), anionic surface active agents, anionic polymers (e.g., polystyrenesulfonic acid), or gelatin derivatives (e.g., aliphatic acylated gelatin, aromatic acylated gelatin and aromatic carbamoylated gelatin) may be used.

Silver halide emulsions are usually chemically sensitized. For this chemical sensitization, for example, the methods as described in H. Frieser ed., *Die Grundlagen Der Photographischen Prozesse mit Silberhalogeniden,* Akademische Verlagsgesellshaft, pages 675 to 734 (1968) can be used. Namely, a sulfur sensitization process using active gelatin or sulfur containing-compounds (e.g., thiosulfates, thioureas, mercapto compounds and rhodanines) capable of reacting with sulfoalkylpolyoxyethylene alkylphenyl ethers, and polyoxyethylene alkylphosphoric acid esters; amphoteric surface active agents, such as amino acids, aminoalkylsulfonic acids, aminoalkylsulfuric acid or aminoalkylphosphoric acid esters, alkylbetaines, and amine oxides; and cationic surface active agents, e.g., alkylamine salts, aliphatic or aromatic quaternary ammonium salts, heterocyclic quaternary ammonium salts (e.g., pyridinium and imidazolium), and aliphatic or heterocyclic phosphonium or sulfonium salts.

The photographic emulsion layer of the photographic material of the present invention may contain compounds such as polyalkylene oxide or its ether, ester, amine or like derivatives, thioether compounds, thiomorpholines, quaternary ammonium salt compounds, urethane derivatives, urea derivatives, imidazole derivatives, and 3-pyrazolidones for the purpose of increasing sensitivity or contrast, or of accelerating development.

In the photographic emulsion layer or other hydrophilic colloid layers of the photographic material of the present invention can be incorporated water-insoluble or sparingly soluble synthetic polymer dispersions for the purpose of improving dimensional stability, etc. Synthetic polymers which can be used include homo- or copolymers of alkyl acrylates or methacrylates, alkoxyalkyl acrylates or methacrylates, glycidyl acrylates or methacrylates, acrylamides or methacrylamides, vinyl esters (e.g., vinyl acetate), acrylonitrile, olefins, styrene, etc. and copolymers.

The photographic emulsion layers or other hydrophilic colloid layers of the photographic material of this invention may include various surface active agents as coating aids or for other various purposes, e.g., prevention of charging, improvement of slipping properties, acceleration of emulsification and dispersion, prevention of adhesion, and improvement of photographic characteristics (for example, development acceleration, high contrast, and sensitization), etc.

Surface active agents which can be used are nonionic surface active agents, e.g., saponin (steroid-based), alkylene oxide derivatives (e.g., polyethylene glycol, a polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamines or polyalkylene glycol alkylamide, and silicone/-polyethylene oxide adducts, etc.), glycidol derivatives (e.g., alkenylsuccinic acid polyglyceride and alkylphenol polyglyceride, etc.), fatty acid esters of polyhydric alcohols, and alkyl esters of sugar, etc.; anionic surface active agents containing an acidic group, such as a carboxy group, a sulfo group, a phospho group, a sulfuric acid ester group, and a phosphoric acid ester group, for example, alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers, and polyoxyethylene alkylphosphoric acid esters; amphoteric surface active agents, such as amino acids, aminoalkylsulfonic acids, aminoalkylsulfuric acid or aminoalkylphosphoric acid esters, alkylbetaines, and amine oxides; and cationic surface active agents, e.g., alkylamine salts, aliphatic or aromatic quaternary ammonium salts, heterocyclic quaternary ammonium salts (e.g., pyridinium and imidazolium), and aliphatic or heterocyclic phosphonium or sulfonium salts.

The photographic emulsion layer of the photographic material of the present invention may contain compounds such as polyalkylene oxide or its ether, ester, amine or like derivatives, thioether compounds, thiomorpholines, quaternary ammonium salt compounds, urethane derivatives, urea derivatives, imidazole derivatives, and 3-pyrazolidones for the purpose of increasing sensitivity or contrast, or of accelerating development.

In the photographic emulsion layer or other hydrophilic colloid layers of the photographic material of the present invention can be incorporated water-insoluble or sparingly soluble synthetic polymer dispersions for the purpose of improving dimensional stability, etc. Synthetic polymers which can be used include homo- or copolymers of alkyl acrylates or methacrylates, alkoxyalkyl acrylates or methacrylates, glycidyl acrylates or methacrylates, acrylamides or methacrylamides, vinyl esters (e.g., vinyl acetate), acrylonitrile, olefins, styrene, etc. and copolymers of the foregoing monomers and acrylic acid, methacrylic acid, $\alpha,\beta$-unsaturated dicarboxylic acids, hydroxyalkyl acrylates or methacrylates, sulfoalkyl acrylates or methacrylates, and styrenesulfonic acid, etc.

In photographic processing of the photographic material of this invention, any of known procedures and known processing solutions, e.g., those described in *Research Disclosure,* No. 17643, (December, 1978) XIX to XXI can be used. The processing temperature is usually chosen from between 18° C. and 50° C., although it may be lower than 18° C. or higher than 50° C.

There may also be used a method wherein a developing agent is incorporated into a photographic material, e.g. an emulsion layer, and the photographic material is processed in an aqueous alkaline solution to conduct development. Hydrophobic developing agents can be incorporated into an emulsion layer by various methods as described in Research Disclosure No. 16928 (May, 1978), U.S. Pat. No. 2,739,890, British Pat. No. 813,253 or West German Pat. No. 1,547,763. The development processing described above may be carried out in combination with a process for stabilizing silver salts using thiocyanates.

Any fixing solutions which have compositions generally used can be used in this invention. As fixing agents, thiosulfuric acid salts and thiocyanic acid salts, and in addition, organic sulfur compounds which are known to be effective as fixing agents can be used. These fixing solutions may contain water-soluble aluminum salts as hardeners.

Positive color images can be formed by any conventional manner, e.g. the negative-positive method as described in *The Journal of the Society of Motion Picture and Television Engineers,* Vol. 61, (1953), pages 667 to 701.

Color developing solutions are usually alkaline aqueous solutions containing color developing agents. As these color developing agents, there can be used known primary aromatic amine developing agents, e.g., phenylenediamines such as 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, etc.

In addition, the compounds as described in L. F. A. Mason, *Photographic Processing Chemistry,* Focal Press, Pages 226 to 229 (1966), U.S. Pat. Nos. 2,193,015 and 2,592,364, Japanese Patent Application (OPI) No. 48-64933, etc., may be used.

The color developing solution can further contain pH buffering agents such as sulfites, carbonates, borates and phosphates of alkali metals, etc. developing restrainers or anti-fogging agents such as bromides, iodides or organic anti-fogging agents, etc. In addition, if desired, the color developing solutions can also contain water softeners; preservatives such as hydroxylamine, etc.; organic solvents such as benzyl alcohol, diethylene glycol, etc.; development accelerators such as polyethylene glycol, quaternary ammonium salts, amines, etc.; dye forming couplers; competing couplers; fogging agents such as sodium borohydride, etc.; auxiliary developing agents such as 1-phenyl-3-pyrazolidone, etc.; viscosity-imparting agents; polycarboxylic acid type chelating agents; anti-oxidizing agents; and the like.

After color development, the photographic emulsion layer is usually bleached. This bleach processing may be performed simultaneously with a fix processing, or they may be performed independently.

Bleaching agents which can be used include compounds of polyvalent metals, e.g., iron (III), cobalt (III), chromium (VI), and copper (II), peracids, quinones and nitroso compounds. For example, ferricyanides; dichromates; organic complex salts of iron (III) or cobalt (III), e.g., complex salts of aminopolycarboxylic acids (e.g., ethylenediaminetetraacetic acid, nitrilotriacetic acid, 1,3-diamino-2-propanoltetraacetic acid, etc.) or complex salts of organic acids (e.g., citric acid, tartaric acid, malic acid, etc.); persulfates; permanganates; nitrosophenol, etc. can be used. Of these compounds, potassium ferricyanide, iron (III) sodium ethylenediaminetetraacetate, and iron (III) ammonium ethylenediaminetetraacetate are particularly useful. Ethylenediaminetetraacetic acid iron (III) complex salts are useful in both an independent bleaching solution and a monobath bleach-fixing solution.

The bleaching or bleach-fixing solution may contain bleach accelerating agents as described in U.S. Pat. Nos. 3,042,520 and 3,241,966, Japanese Patent Publication Nos. 45-8506 and 45-8836, etc. thiol compounds as described in Japanese Patent Application (OPI) No. 53-65732, and other additives.

The photographic emulsion used in the present invention can also be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these days, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthothiazole nucleus, a benzoselenazole nucleus, a benzimidazole nucleus, a quinoline nucleus, etc., are appropriate. The carbon atoms of these nuclei can also be substituted.

The merocyanine dyes and the complex merocyanine dyes that can be employed contain 5- or 6-membered heterocyclic nuclei such as a pyrazolin-5-one nucleus, a thiohydantoin nucleus, a 2-thiooxazolidin-2,4-dione nucleus, a thiazolidine-2,4-dione nucleus, a rhodanine nucleus, a thiobarbituric acid nucleus, and the like.

These sensitizing dyes can be employed individually, and can also be employed in combination. A combination of sensitizing dyes is often used particularly for the purpose of supersensitization.

The sensitizing dyes may be present in the emulsion together with dyes which themselves do not give rise to spectrally sensitizing effects but exhibit a supersensitizing effect or materials which do not substantially absorb visible light but exhibit a supersensitizing effect.

The present invention is also applicable to a multilayer multicolor photographic material containing layers sensitive to at least two different spectral wavelength ranges on a support. A multilayer natural color photographic material generally possesses at least one red-sensitive silver halide emulsion layer, at least one green-sensitive silver halide emulsion layer and at leaast one blue-sensitive silver halide emulsion layer on a support. The order of these layers can be varied, if desired. Ordinarily, a cyan dye-forming coupler is incorporated into a red-sensitive emulsion layer, a magenta dye-forming coupler is incorporated into a green-sensitive emulsion layer and a yellow dye-forming coupler is incorporated into a blue-sensitive emulsion layer, respectively. However, if desired, a different combination can be emplyed.

The photographic emulsion layers or light-sensitive layers of the photographic material of the present invention may contain, in addition to the compounds described above, other dye forming couplers, i.e., compounds capable of forming color upon oxidative coupling with aromatic primary amine developing agents (e.g., phenylenediamine derivatives, aminophenol derivatives, etc.) during color development processing. Examples of such couplers include magenta couplers, such as 5-pyrazolone couplers, pyrazolobenzimidazole couplers, pyrazoloimidazole couplers, pyrazolopyrazole couplers, pyrazolotriazole couplers, pyrazolotetrazole couplers, cyanoacetyl coumarone couplers are open chain acylacetonitrile couplers, etc.; yellow couplers, such as acylacetamide couplers (e.g.: benzoylacetanilides, pivaloylacetanilides, etc.), etc.; and cyan couplers, such as naphthol couplers and phenol couplers, etc. It is preferable to use non-diffusible couplers containing a hydrophobic group (so-called ballast group) in the molecule or polymeric couplers. They may be either 4-equivalent or 2-equivalent with respect to silver ions. It is also possible to use colored couplers capable of exerting color correction effects.

In the present invention, diffusable DIR compounds can be incorporated into not only the light-insensitive layer but also into the light-sensitive layers or interlayers. The diffusible DIR compounds may also be incorporated into layers in which a color dye having a different hue is formed.

Further, the emulsion layer may contain a colorless compound forming DIR coupler which release a low- or non-diffusible development restrainer.

Moreover, the photographic material of the present invention may contain a compound which releases a low- or non-diffusible development restrainer during development.

It is to be understood that two or more kinds of the above-described couplers can be incorporated together into the same layer and that the same compound can be incorporated into two or more layers, for the purpose of satisfying the properties required of photographic materials.

Photographic color dye-forming compounds are advantageously selected so as to give a medium scale image. It is preferred that the maximum absorption band of cyan dye produced by cyan dye-forming compound extend from about 600 to 720 nm, that of magenta dye produced by magneta dye-forming compound from about 500 to 580 nm and that of yellow dye produced by yellow dye-forming compound from about 400 to 480 nm.

The photographic material of the present invention may contain inorganic or organic hardeners in the photographic emulsion layer and other hydrophilic colloid layers thereof. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), and mucohalogenic acids (e.g., mucochloric acid, mucophenoxychloric acid, etc.) can be used alone or in combination with each other.

In the photographic material of the invention, when dyes, ultraviolet ray absorbing agents, and the like are incorporated in the hydrophilic colloid layers, they may be mordanted with cationic polymers, etc.

The photographic material of the present invention may contain therein hydroquinone derivatives, aminophenol derivatives, gallic acid derivatives, ascorbic acid derivatives, etc., as color fog preventing agents.

Specific examples of the above-mentioned compounds are described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 50-92988, 50-92989, 50-93928, 50-110337 and 52-146235, Japanese Patent Publication No. 50-23813, etc.

The hydrophilic colloid layers of the photographic material of the present invention can contain ultraviolet ray absorbing agents. For example, there can be used benzotriazole compounds substituted by an aryl group (e.g., those described in U.S. Pat. No. 3,533,794), 4-thiazolidone compounds (e.g., those described in U.S. Pat. Nos. 3,314,794 and 3,352,681), benzophenone compounds (e.g., those described in Japanese Patent Application (OPI) No. 46-2784), cinnamic acid ester compounds (e.g., those described in U.S. Pat. Nos. 3,705,805 and 3,707,375), butadiene compounds (e.g., those described in U.S. Pat. No. 4,045,229) or benzoxazole compounds (e.g., those described in U.S. Pat. No. 3,700,455). Ultraviolet ray absorbing couplers (e.g., 60-naphthol type cyan dye-forming couplers) and ultraviolet ray absorbing polymers can also be employed. These ultraviolet ray absorbing agents can also be mordanted in a specific layer(s), if desired.

The photographic material of the present invention may contain water-soluble dyes in the hydrophilic colloid layers thereof as filter dye or for various purposes, e.g., irradiation prevention. Examples of such dyes include oxonol dyes, hemioxonol dyes, styryl dyes, merocyanine dyes, cyanine dyes, and azo dyes. In particular, oxonol dyes, hemioxonol dyes, and merocyanine dyes are useful.

In carrying out the present invention, known color fading preventing agents can be used together. Color image stabilizers can be used alone or in combination with each other. Typical known color fading preventing agents include hydroquinone derivatives, gallic acid derivatives, p-alkoxyphenols, p-oxyphenol derivatives, and bisphenols, etc.

Examples of the hydroquinone derivatives are described in U.S. Pat. Nos. 2,360,290, 2,418,613, 2,675,314, 2,701,197, 2,704,713, 2,728,659, 2,732,300, 2,735,765, 2,710,801 and 2,816,028, and British Pat. No. 1,363,921, etc., those of the gallic acid derivatives in U.S. Pat. Nos. 3,457,079 and 3,069,262, those of the p-alkoxyphenols in U.S. Pat. Nos. 2,735,765 and 3,698,909, Japanese Patent Publication Nos. 49-20977 and 52-6623, those of the p-oxyphenol derivatives in U.S. Pat. Nos. 3,432,300, 3,573,050, 3,574,627 and 3,764,337, Japanese Patent Application (OPI) Nos. 52-35633, 52-147434 and 52-152225 and those of the bisphenols in U.S. Pat. No. 3,700,455.

This invention will now be explained in more detail with reference to the following Examples to which this invention is not limited.

EXAMPLE 1

On a cellulose triacetate film support, there was prepared a multilayer color photographic material consisting of the following layers.

1st layer: Antihalation layer comprising gelatin containing black colloidal silver
Black colloidal silver: 0.2 g/m$^2$
Gelatin: 1.8 g/m$^2$ 2nd layer: Interlayer comprising gelatin
Gelatin: 1.5 g/m$^2$ 3rd layer: First red-sensitive emulsion layer comprising a composition prepared by absorbing sensitizing dyes I, II and III on silver bromoiodide grains (average grain size of 0.45 micron, 6 mole % AgI), adding 4-hydroxy-6-methyl-1,3,3a,7-tetraazaindene, followed by mixing with an emulsified dispersion of couplers EC-1 and D-33.
Silver halide (the amount of silver): 2.1 g/m$^2$
Gelatin: 2.8 g/m$^2$
Sensitizing dye I: $6.2\times10^{-5}$ mole/l mole Ag
Sensitizing dye II: $1.9\times10^{-4}$ mole/l mole Ag
Sensitizing dye III: $1.7\times10^{-5}$ mole/l mole Ag
Coupler EC-1: 0.040 mole/l mole Ag
Coupler D-33: 0.0034 mole/l mole Ag Couplers EC-1 and D-33 were dissolved in a mixed solvent of tricresylphosphate and ethyl acetate. The solution was mixed with a gelatin solution of sodium di-(2-ethylhexyl)-α-sulfosuccinate and was then mechanically stirred to form the emulsified dispersion.

4th layer: Second red-sensitive emulsion layer comprising a composition prepared by adsorbing sensitizing dyes I, II and III on silver bromoiodide grains (average grain size of 0.70 micron, 8 mole % AgI), adding 4-hydroxy-6-methyl-1,3,3a,7-tetraazaindene, followed by mixing with an emulsified dispersion of couplers EC-1 and EC-2.
Silver halide (the amount of silver): 0.7 g/m$^2$
Gelatin: 0.9 g/m$^2$
Sensitizing dye I: $5.5\times10^{-5}$ mole/l mole Ag
Sensitizing dye II: $1.7\times10^{-4}$ mole/l mole Ag
Sensitizing dye III: $1.5\times10^{-5}$ mole/l mole Ag
Coupler EC-1: 0.021 mole/l mole Ag
Coupler EC-2: 0.007 mole/l mole Ag The dispersion of couplers EC-1 and EC-2 was prepared and added in the same manner as the dispersion of the first red-sensitive layer.

5th layer: Interlayer comprising an emulsified dispersion of 2,5-di-t-octylhydroquinone
2,5-Di-t-octylhydroquinone: 0.05 g/m$^2$
Gelatin: 1.1 g/m$^2$ 6th layer: First green-sensitive emulsion layer comprising a composition prepared by adsorbing sensitizing dyes IV and V on silver bromoiodide grains (average grain size of 0.45 micron, 6 mole % AgI), adding 4-hydroxy-6-methyl-1,3,3a,7-tetraazaindene, followed by mixing with an emulsified dispersion of couplers EM-1, EM-2 and D-33.
Silver halide (the amount of silver): 1.2 g/m$^2$
Gelatin: 1.8 g/m$^2$
Sensitizing dye IV: $5.2\times10^{-4}$ mole/l mole Ag
Sensitizing dye V: $2.1\times10^{-4}$ mole/l mole Ag
Coupler EM-1: 0.067 mole/l mole Ag
Coupler EM-2: 0.018 mole/l mole Ag
Coupler D-33: 0.0064 mole/l mole Ag Couplers EM-1, EM-2 and D-33 were dissolved in a mixed solvent of tricresylphosphate, dibutyl phosphate and ethyl acetate. The solution was mixed with a gelatin solution containing sodium dodecylbenzenesulfonate and was then mechanically stirred to form the emulsified dispersion.

7th layer: Second green-sensitive emulsion layer comprising a composition prepared by adsorbing sensitizing dyes IV and V on silver bromoiodide grains (average grain size of 0.75 micron, 7.5 mole % AgI), adding 4-hydroxy-6-methyl-1,3,3a,7-tetraazaindene, followed by mixing with an emulsified dispersion of couplers EM-2, EM-3 and EM-4.
Silver halide (the amount of silver): 1.0 g/m$^2$
Gelatin: 1.2 g/m$^2$
Sensitizing dye IV: $3.1\times10^{-4}$ mole/l mole Ag
Sensitizing dye V: $1.3\times10^{-4}$ mole/l mole Ag
Coupler EM-2: 0.0033 mole/l mole Ag
Coupler EM-3: 0.0096 mole/l mole Ag
Coupler EM-4: 0.0041 mole/l mole Ag The dispersion of couplers EM-2, EM-3 and EM-4 was prepared and added in the same manner as the dispersion of the first green-sensitive layer.

8th layer: Interlayer comprising yellow colloidal silver and 2,5-di-t-octylhydroquinone
Colloidal silver: 0.12 g/m$^2$
2,5-Di-t-octylhydroquinone: 0.10 g/m$^2$
Gelatin: 1.5 g/m$^2$ 9th layer: First blue-sensitive emulsion layer comprising a composition prepared by adding to silver bromoiodide emulsion (average grain size of 0.5 micron, 6.3 mole % AgI), 4-hydroxy-6-methyl-1,3,3a,7-tetraazaindene, followed by mixing with an emulsified dispersion of couplers EY-1 and D-33.
Silver halide (the amount of silver): 0.51 g/m$^2$
Gelatin: 1.4 g/m$^2$
Coupler EY-1: 0.28 mole/l mole Ag
Coupler D-33: 0.018 mole/l mole Ag Couplers EY-1 and D-33 were dissolved in a mixed solvent of tricresylphosphate and ethyl acetate. The solution was mixed with a gelatin solution of sodium dodecylbenzenesulfonate and was then mechanically stirred to form the emulsified dispersion.

10th layer: Second blue-sensitive emulsion layer comprising a composition prepared by absorbing sensitizing dye VI on silver bromoiodide grains (average grain size of 0.75 micron, 8.5 mole % AgI), adding 4-hydroxy-6-methyl-1,3,3a,7-tetraazaindene, followed by mixing with an emulsified dispersion of couplers EY-1 and D-33.

Silver halide (the amount of silver): 0.73 g/m$^2$

Gelatin: 0.83 g/m$^2$

Sensitizing dye VI: $1.9\times10^{-4}$ mole/l mole Ag

Coupler EY-1: 0.026 mole/l mole Ag

Coupler D-33: 0.010 mole/l mole Ag

The dispersion of couplers EY-1 and D-33 was prepared and added in the same manner as the dispersion of the first blue-sensitive emulsion layer.

11th layer: Protective layer comprising gelatin containing polymethylmethacrylate particles (average particle size of 1.8 microns)

Polymethylmethacrylate: 0.02 g/m$^2$

Gelatin: 1.5 g/m$^2$

To each of the first to 11th layers, sodium 2-hydroxy-4,6-dichloro-s-triazine (a gelatin hardener) and coating aids if necessary were added and coated on the support.

Sample a was obtained.

In Sample a, Coupler D-33 was removed from the 10th layer and an interlayer comprising gelatin and Coupler D-33 and containing no silver halide was provided between the 10th and the 11th layers to prepare Sample b.

Gelatin: 0.5 g/m$^2$

Coupler D-33: $8.8\times10^{-5}$ mole/m$^2$

In Sample a, Coupler D-33 was removed from the 10th layer and an interlayer comprising gelatin and Coupler D-33 and containing no silver halide was provided between the 9th and the 10th layers to prepare Sample c.

Gelatin: 0.5 g/m$^2$

Coupler D-33: $8.8\times10^{-5}$ mole/m$^2$

In Sample a, Coupler D-33 was removed from the 10th layer and the amount of Coupler D-33 in the 9th layer was increased as follows to prepare Sample d.

Coupler D-33: 0.037 mole/l mole Ag

In Sample a, Coupler D-33 was removed from the 9th layer and an interlayer comprising gelatin, and Coupler D-33 and containing no silver halide was provided between the 8th and the 9th layers to prepare Sample e.

Gelatin: 0.5 g/m$^2$

Coupler D-33: $1.1\times10^{-4}$ mole/m$^2$

In Sample a, Coupler D-33 was removed from the 10th layer and Coupler EY-2 instead was added thereto to prepare Sample f.

Coupler EY-2: 0.0065 mole/l mole Ag

In Sample b, Coupler D-33 was removed from the interlayer provided between the 10th and the 11th layers and Coupler EY-2 instead was added thereto to prepare Sample g.

Coupler EY-2: $5.7\times10^{-4}$ mole/m$^2$

Samples a, b, c, d, e, f and g were exposed to white light at a color temperature of 4800° K. and subjected to a color development processing explained later. Graininess of these samples were measured by the conventional RMS method. RMS values are those measured by a circular aperture of 48 microns in diameter at a yellow density of fog density plus 0.4.

The samples were exposed to white light at a color temperature of 4800° K. at such an exposure value that the exposed Sample a gave a yellow density of fog plus 1.2 when it was color-developed for 3 minutes 15 seconds. Two Samples exposed at the respective exposure values were color-developed for 3 minutes 15 seconds and 2 minutes 35 seconds, respectively. Developability is defined as the difference between a yellow density obtained by the color development for 3 minutes 15 seconds and that obtained by the color development for 2 minutes 35 seconds.

In order to evaluate the effects on developability of other layers, a difference in magenta density between developments for 3 minutes 15 seconds and 2 minutes 35 seconds was measured for the samples exposed at such an exposure value that Sample a gave a magenta density of fog plus 1.0 when it was developed for 3 minutes 15 seconds.

In order to evaluate the interlayer development restraining effect, each of the samples was uniformly exposed to green light so as to obtain a magenta density of fog plus 1.0 after it was processed, and then it was exposed to blue light through an optical wedge at such an exposure value that Sample a gave a yellow density of fog plus 0.6, followed by the measurement of the magenta density. Interlayer development restraining effect is defined as the amount of decrease in magenta density.

The results are summarized in Table 1

The color development was carried out according to the following procedures.

1. Color development (38° C.): 3 min. 15 sec.
2. Bleaching: 6 min. 30 sec.
3. Water washing: 2 min. 10 sec.
4. Fixing: 4 min. 20 sec.
5. Water washing: 3 min. 15 sec.
6. Stabilizing: 1 min. 05 sec.

The compositions of the processing liquids used in the steps were as follows:

Color developing solution

Sodium nitrilotriacetate: 1.0 g

Sodium sulfite: 4.0 g

Sodium carbonate: 30.0 g

Potassium bromide: 1.4 g

Hydroxylamine sulfate: 2.4 g 4-(N-ethyl-N-beta-hydroxyethylamino)-2-methylaniline sulfate: 4.5 g Water to: 1.0 l Bleaching solution Ammonium bromide: 160.0 g Ammonia water (28%): 25.0 ml Ethylenediaminetetraacetic acid ferric sodium salt: 130.0 g Glacial acetic acid: 14.0 ml Water to: 1.0 l Fixing solution Sodium tetrapolyphosphate: 2.0 g Sodium sulfite: 4.0 g Ammonium thiosulfate (70%): 175.0 ml Sodium bisulfite: 4.6 g Water to: 1.0 l Stabilizing solution Formalin: 8.0 ml Water to: 1.0 l

TABLE 1

| Sample | Sensitivity | Graininess RMS | Interlayer development restraining effect Δ M 1.2 | Developability Y (3'15"–2'35") | Developability M (3'15"–2'35") |
|---|---|---|---|---|---|
| a (Comparative Example) | 100 | 0.029 | 0.14 | 0.24 | 0.26 |
| b | 107 | 0.023 | 0.17 | 0.19 | 0.20 |

TABLE 1-continued

| Sample | Sensitivity | Graininess RMS | Interlayer development restraining effect Δ M 1.2 | Developability Y (3'15"–2'35") | Developability M (3'15"–2'35") |
|---|---|---|---|---|---|
| (This Invention) c | 105 | 0.022 | 0.18 | 0.19 | 0.20 |
| (This Invention) d | 112 | 0.033 | 0.09 | 0.26 | 0.26 |
| (Comparative Example) e | 115 | 0.035 | 0.08 | 0.27 | 0.28 |
| (Comparative Example) f | 100 | 0.028 | 0.06 | 0.23 | 0.27 |
| (Comparative Example) g | 98 | 0.026 | 0.08 | 0.22 | 0.25 |
| (Comparative Example) | | | | | |

The greater the value of the interlayer development restraining effect and the smaller the value of the developability, the better the quality of the photographic material.

Comparative Sample a shows a little better graininess and interlayer development restraining effect because the development is fairly restrained in low density areas but shows inferior developability. On the contrary, Comparative Sample d and e are inferior in all of graininess, interlayer development restraining effect and developability because the development is little restrained in low density areas. Comparative Samples f and g show a little better graininess but they are very low in interlayer development restraining effect and a little worse in developability. Samples b and c of the present invention are clearly excellent in graininess, interlayer development restraining effect and developability.

EXAMPLE 2

Sample a was modified as follows to prepare Sample h.

1st layer: The same as Sample a

2nd layer: The same as Sample a

3rd layer: Couplers EC-1 and D-33 were replaced by Couplers EC-3, EC-4 and D-14.

Coupler EC-3: 0.049 mole/l mole Ag

Coupler EC-4: 0.0036 mole/l mole Ag

Coupler D-14: 0.0036 mole/l mole Ag

4th layer: Couplers EC-1 and EC-2 were replaced by Couplers EC-3, EC-4 and D-14.

Coupler EC-3: 0.019 mole/l mole Ag

Coupler EC-4: 0.0039 mole/l mole Ag

Coupler D-14: 0.00057 mole/l mole Ag

5th layer: The same as Sample a

6th layer: Coupler D-13 was replaced by Coupler D-27.

Coupler D-27: 0.0077 mole/l mole Ag

7th layer: Coupler D-27 was added and the amount of Coupler EM-4 was changed.

Coupler EM-4: 0.0036 mole/l mole Ag

Coupler D-27: 0.00045 mole/l mole Ag

8th layer: The same as Sample a

9th layer: Coupler D-33 was replaced by Coupler D-31.

Coupler D-31: 0.024 mole/l mole Ag

10th layer: Coupler D-33 was replaced by Coupler D-31.

Coupler D-31: 0.013 mole/l mole Ag

11th layer: The same as Sample a

Sample h was modified as follows to prepare Sample i.

(1) 3rd layer: The amount of Couler D-14 was changed as follows.

Coupler D-14: 0.0038 mole/l mole Ag (2) 4th layer: Coupler D-14 was removed.

(3) 6th layer: The amount of Coupler D-27 was changed as follows.

Coupler D-27: 0.0082 mole/l mole Ag (4) 7th layer: Coupler D-27 was removed.

(5) 9th layer: The amount of Coupler D-31 was changed as follows.

Coupler D-31: 0.046 mole/l mole Ag (6) 10th layer: Coupler D-31 was removed.

Sample h was modified as follows to prepare Sample j.

(1) An interlayer comprising gelatin and Coupler D-14 was provided between the 3rd and the 4th layers.

Gelatin: 0.5 g/m$^2$

Coupler D-14: $4.4\times10^{-6}$ mole/m$^2$ (2) 4th layer: Coupler D-14 was removed.

(3) An interlayer comprising gelatin and Coupler D-27 was provided between the 6th and the 7th layers.

Gelatin: 0.5 g/m$^2$

Coupler D-27: $5\times10^{-6}$ mole/m$^2$ (4) 7th layer: Coupler D-27 was removed.

(5) An interlayer comprising gelatin and Coupler D-31 was provided between the 10th and the 11th layers.

Gelatin: 0.5 g/m$^2$

Coupler D-31: $1.1\times10^{-4}$ mole/m$^2$ (6) 10th layer: Coupler D-31 was removed.

Graininess, interlayer development restraining effect and developability of Samples h, i and j were measured in the same manner as in Example 1 except for the measuring conditions which were modified as follows.

Graininess:

For the cyan color, RMS value measured at the density of fog plus 0.2.

For the magenta color, RMS value measured at the density of fog plus 0.3.

For the yellow color, RMS value measured at the density of fog plus 0.4.

Developability:

For the yellow and magenta colors, the same manner as in Example 1 was applied to measure difference in density except that Sample h was used as a control instead of Sample a.

For the cyan color, the exposure value that gave a cyan density of fog plus 0.8 was used.

Interlayer development restraining effect: sure value of 1.0 log exposure unit in the direction of greater exposure from the point at which the density is 0.15 above that of the fog of the curve.

TABLE 2

| Sample | Sensitivity | | | Graininess | | | Interlayer development restraining effect | | | Developability | | |
|---|---|---|---|---|---|---|---|---|---|---|---|---|
| | C | M | Y | C | M | Y | C | M | Y | C | M | Y |
| h (Comparative Example) | 100 | 100 | 100 | 0.021 | 0.019 | 0.032 | 0.24 | 0.26 | 0.13 | 0.25 | 0.26 | 0.35 |
| i (Comparative Example) | 109 | 109 | 112 | 0.024 | 0.024 | 0.036 | 0.20 | 0.20 | 0.08 | 0.23 | 0.24 | 0.25 |
| j (This Invention) | 105 | 105 | 107 | 0.018 | 0.014 | 0.024 | 0.26 | 0.30 | 0.18 | 0.21 | 0.19 | 0.20 |

The greater the value of interlayer development restraining effect and the smaller the value of developability, the better the quality of the photographic material.

The Samples were exposed to white-light at a color temperature of 4800° K. through an optical wedge to prepare characteristic curves for each of cyan, magenta and yellow colors. Separately, the Samples were exposed to red-, green- and blue-light through an optical wedge to prepare characteristic curves for each color.

The interlayer development restraining effect is defined by the difference between density of white-light exposure and that of color-light exposure at the expo- Comparative Sample h is superior to Comparative Sample i in graininess and interlayer development restraining effect but they do not differ in developability. Sample j of this invention is superior to Comparative Samples h and i in not only developability but also graininess and interlayer development restraining effect.

The compounds used in the above Examples were as follows.

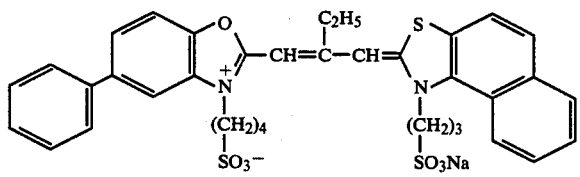

Sensitizing Dye I

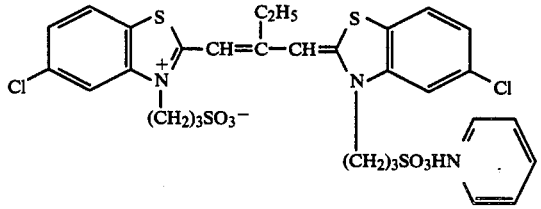

Sensitizing Dye II

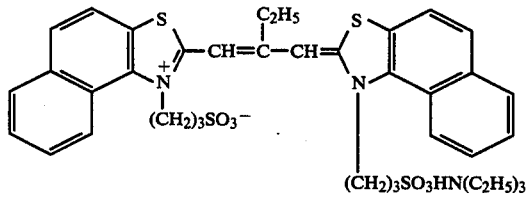

Sensitizing Dye III

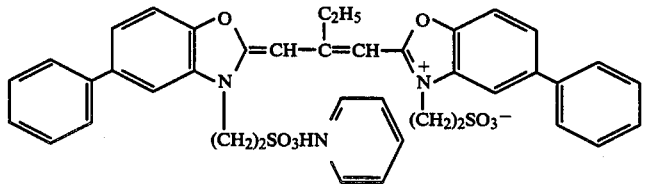

Sensitizing Dye IV

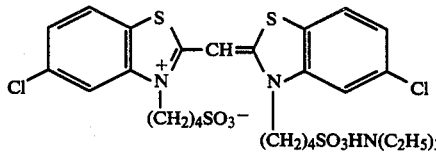

Sensitizing Dye V

-continued
Sensitizing Dye VI
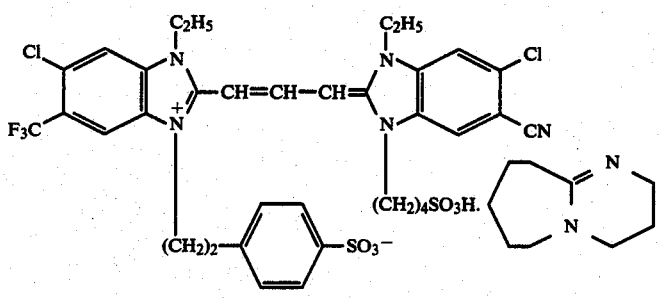
EC-1
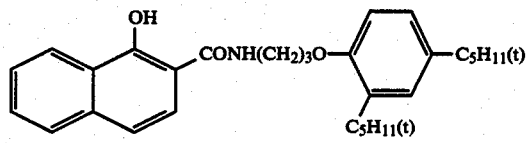
EC-2
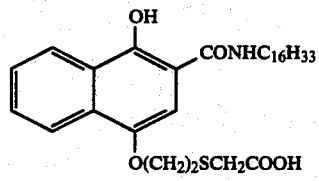
EC-3
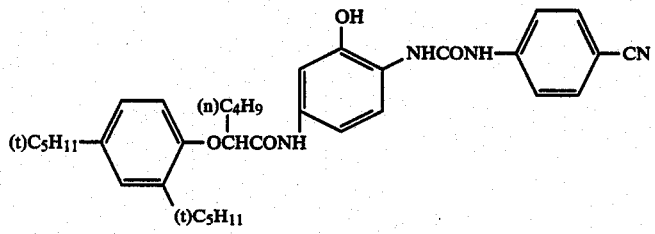
EC-4
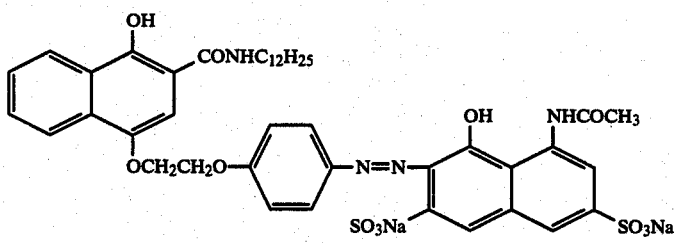
EM-1
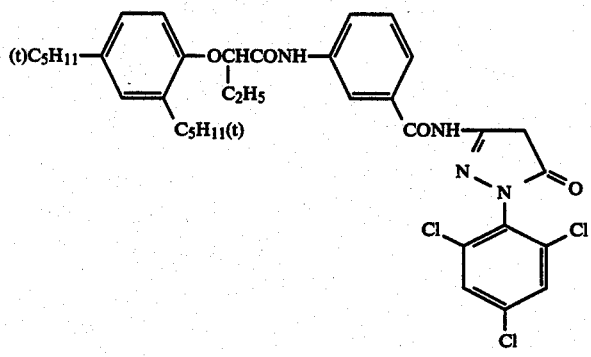

-continued
EM-2
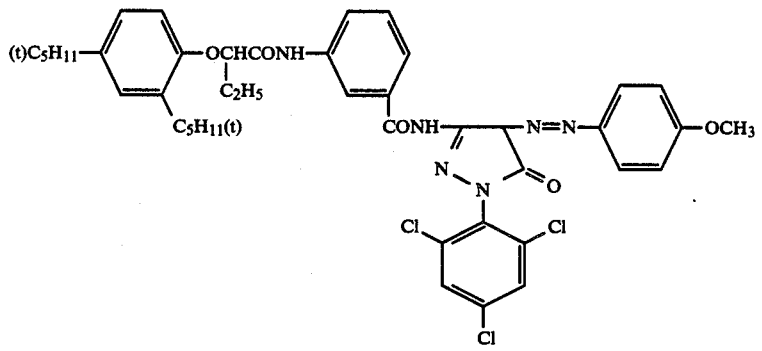
EM-3
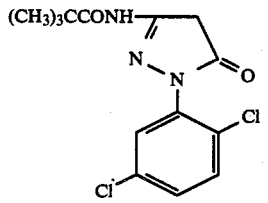
EM-4
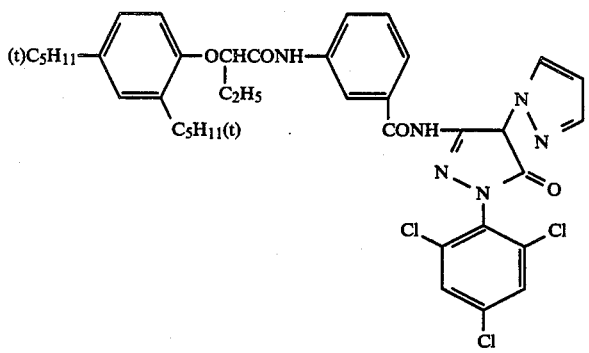
EY-1
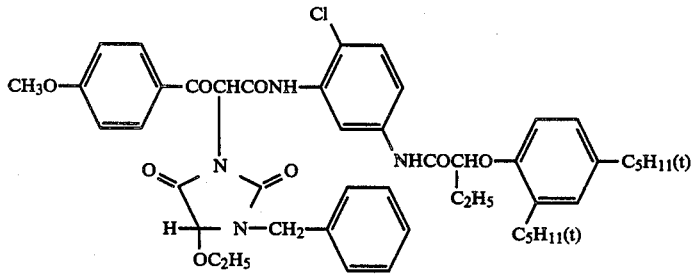
EY-2
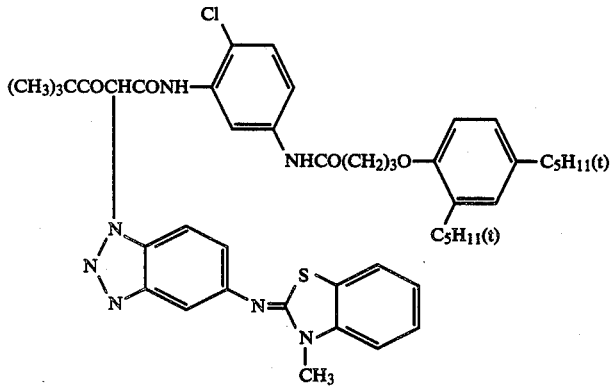
What we claim is:
1. A silver halide color photographic material which comprises a support having thereon at least two silver halide light-sensitive layers having essentially the same color sensitivity but different speeds, and a light-insensitive layer positioned adjacent to the highest-speed layer of said light-sensitive layers and containing a compound which reacts with the oxidation products of a color developing agent to form a diffusible development restraining compound or a precursor thereof.

2. The silver halide color photographic material of claim 1 wherein the magnitude of diffusibility of said diffusible development restraining compound or said precursor thereof is in the range of 0.4 to 0.95.

3. The silver halide color photographic material of claim 1, wherein said compound which reacts with the oxidation products of a color developing agent to form a diffusible development restraining compound or a precursor thereof is a diffusible development inhibitor releasing (DIR) coupler.

4. The silver halide color photographic material of claim 3, wherein said diffusible DIR coupler is represented by the formula (I):

$$A\text{-}(Y)_m \qquad (I)$$

wherein A represents a coupler component, m represents an integer of 1 or 2 and Y represents a coupling-off group which is linked to a coupling position of the coupler component A and can be eliminated from the coupler component upon the reaction with the oxidation products of a color developing agent to release a highly diffusible development restrainer or a precursor thereof.

5. The silver halide color photographic material of claim 4, wherein said group Y is represented by the formula (IIa), (IIb), (III), (IV) or (V):

[IIa]

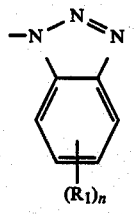

[IIb]

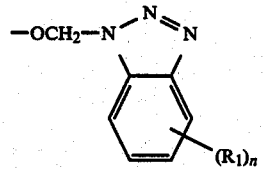

-continued

[III]

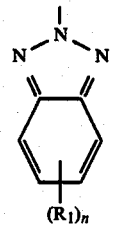

[IV]

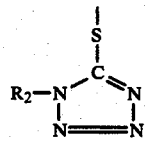

[V]

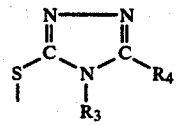

wherein $R_1$ represents alkyl, alkoxy, acylamino, halogen, alkoxycarbonyl, thiazolilideneamino, aryloxycarbonyl, acyloxy, carbamoyl, N-alkylcarbamoyl, N,N-dialkylcarbamoyl, nitro, amino, N-arylcarbamoyloxy, sulfamoyl, N-alkylcarbamoyloxy, hydroxy, alkoxycarbonylamino, alkylthio, arylthio, aryl, hetero ring, cyano, alkylsulfonyl or aryloxycarbonylamino group, n represents an integer of 1 or 2, if n is 2, $R_1$ may be the same or different and the total number of carbons contained in n $R_1$ is 0 to 10, $R_2$ represents alkyl or aryl group or hetero ring, $R_3$ represents hydrogen, alkyl or aryl group or hetero ring, $R_4$ represents hydrogen, alkyl or aryl group, halogen, acylamino, alkoxycarbonylamino, aryloxycarbonylamino, hetero ring, alkylthio or amino group.

6. The silver halide color photographic material of claim 1, wherein said light-insensitive layer does not comprise any dye-forming coupler other than said compound.

7. The silver halide color photographic material of claim 1, which further comprises a light-insensitive layer containing light-insensitive silver halide grains.

8. The silver halide color photographic material of claim 1, wherein said light-insensitive layer is positioned on the side near to said support with respect to the highest-speed layer.

9. The silver halide color photographic material of claim 1, wherein said light-insensitive layer is positioned on the side remote from said support with respect to the highest-speed layer.

10. The silver halide color photographic material of claim 1, wherein said light-insensitive layer is positioned adjacent to the blue-sensitive highest-speed layer.

11. The silver halide color photographic material of claim 1, wherein said light-insensitive layer is positioned adjacent to the green-sensitive highest-speed layer.

12. The silver halide color photographic material of claim 1, wherein said light-insensitive layer is positioned adjacent to the red-sensitive highest-speed layer.

* * * * *